United States Patent [19]

Stalder et al.

[11] Patent Number: 4,628,679

[45] Date of Patent: Dec. 16, 1986

[54] METHOD AND APPARATUS FOR THE PRODUCTION OF A YARN BY OPEN-END FRICTION SPINNING

[75] Inventors: Herbert Stalder, Kollbrunn; Josef Baumgartner, Sirnach, both of Switzerland

[73] Assignee: Rieter Machine Works Limited, Winterthur, Switzerland

[21] Appl. No.: 773,998

[22] Filed: Sep. 9, 1985

[30] Foreign Application Priority Data

Sep. 25, 1984 [CH] Switzerland ..... 4579/84

[51] Int. Cl.[4] ..... D01H 7/892; D01H 1/135

[52] U.S. Cl. ..... 57/401; 57/411; 57/413

[58] Field of Search ..... 57/400, 401, 408, 411, 57/413

[56] References Cited

U.S. PATENT DOCUMENTS 4,130,983 12/1978 Dammann et al. ..... 57/401 X
4,483,136 11/1984 Stahlecker et al. ..... 57/401
4,522,023 6/1985 Stahlecker ..... 57/401
4,557,105 12/1985 Brockmanns et al. ..... 57/401

FOREIGN PATENT DOCUMENTS 3300636 7/1984 Fed. Rep. of Germany .
3318924 11/1984 Fed. Rep. of Germany .
2062023 5/1981 United Kingdom .

*Primary Examiner*—John Petrakes
*Attorney, Agent, or Firm*—Werner W. Kleeman

[57] ABSTRACT

A method and an apparatus for production of yarn by friction spinning is disclosed. The friction spinning method employs a perforated friction spinning drum towards which a fibre feed passage projects. An opening roller, known from the open-end rotor spinning process, feeds separated fibres into the fibre feed passage, which fibres are taken up by a transport air flow in the fibre feed passage. This transport air flow is produced by the perforated friction spinning drum which is subjected to underpressure. Fibres leaving an opening of the fibre feed passage are laid in an inclined disposition on the perforated friction spinning drum and transported in this disposition towards a yarn end forming at a yarn formation position. The spun yarn is withdrawn by a withdrawal roller pair. Advantageously, a second friction spinning drum is provided parallel to the first perforated friction spinning drum to cause the fibre twisting-in process to take place in a more accurately defined manner.

20 Claims, 14 Drawing Figures

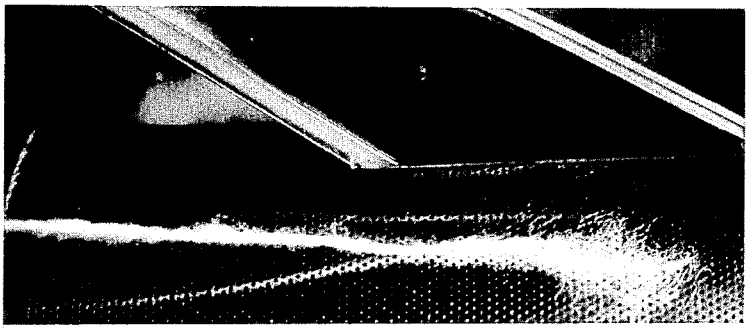

METHOD AND APPARATUS FOR THE PRODUCTION OF A YARN BY OPEN-END FRICTION SPINNING

BACKGROUND OF THE INVENTION

The present invention broadly relates to the production of yarn from fibres and, more specifically, pertains to a new and improved method and apparatus for the production of a yarn or the like by means of a friction spinning device.

Generally speaking, the method of the present invention is for spinning a yarn or the like by the open-end friction spinning principle and comprises the steps of: separating fibres from a fibre sliver; transporting the separated fibres in a freely floating condition by means of a pneumatic, fibre-transporting air stream to a moving, perforated surface of a friction spinning means subjected to underpressure; transporting the transferred fibres by means of the moving perforated surface to a yarn formation position in which the transported fibres are formed to a yarn; and withdrawing the formed yarn in a predetermined withdrawal direction.

The apparatus of the present invention is intended for spinning a yarn or the like and comprises: an opening roller of a type employed in open-end rotor spinning; a movable friction spinning means comprising a perforated surface; means for drawing an air stream through the perforated surface of the movable friction spinning means; a fibre feed passage situated between the opening roller and the perforated surface of the friction spinning means for pneumatically transporting fibres from the opening roller to the perforated surface; the fibre feed passage having an exit opening; the exit opening having a longitudinal section; the longitudinal section having longitudinal sides; the longitudinal sides being arranged substantially transverse to a direction of movement of the perforated surface; the fibre feed passage being so inclined in relation to the longitudinal section of the exit opening that the fibres in the pneumatic, fibre-transporting air stream are transported in a direction which is forwardly inclined as viewed in a yarn withdrawal direction; a yarn formation position which is formed on the movable friction spinning means by a lower wall of a suction passage defining a suction zone at a predetermined spacing from the exit opening as viewed in a direction of movement of the movable friction spinning means; and the suction passage being arranged on the perforated surface of the movable friction spinning means opposite to the fibre feed passage and the yarn formation position.

If in friction spinning the fibre sliver is separated into individual fibres by means of an opening or opener roller in a manner similar to that used in rotor spinning, and these fibres are supplied by means of a passage or fibre feed passage towards a friction spinning means, then a disorientation of the fibres can arise in the passage; at least some of the fibres pass towards the exit opening of the passage in a non-straight or bent condition. This disorientation of non-straight or bent fibres is, however, detrimental to an orderly yarn structure, since non-straight or bent fibres, or fibres which may even be kinked or have loops, produce a yarn of relatively low strength and with undesirable irregularity.

A device is known, for example from Swiss Pat. No. 572,108, in which freely moving fibres are fed into converging space between two aspirated rolls rotating in the same sense. The fibres are twisted to a yarn by the rotation of the rolls and are withdrawn by withdrawal rollers provided at the end faces of the rolls.

It is clear that these freely moving fibres must be supplied in a pneumatic feed passage and correspondingly have a final speed which can be about ten times greater than the withdrawal speed of the yarn, so that the fibres arriving in the converging space are braked to a so much lower speed that they assume some kind of loop state or configuration on arrival and these loop states or configurations are substantially retained in the spun yarn.

Loop states or configurations of the fibres in a yarn reduce the strength of the yarn and provide a source of irregularities, since the large number of simultaneously arriving fibres assuming such loop states or configurations produces disorientation or misalignment of the fibres. Furthermore, such a loop state or configuration shortens the useful fibre length. The term "loop state or configuration" of a fibre refers generally to a fibre which is substantially shortened in its above-mentioned useful length through loop formation, bending or kinking.

To a certain degree, stretching of the yarn, and thus also stretching of the individual fibres, is produced by the withdrawal of the yarn as a result of the retention resistance or force in the convergent space or throat of the two drums; this however is insufficient to enable the properties of such a yarn to compare, for example, with those of a ring-spun yarn, so that this type of spinning is suitable substantially only for production of coarser yarns with a statistically better distribution of the individual weak points. The term "coarser yarns" refers generally to yarns used primarily for the production of decorative materials.

In relation to new spinning methods, for example friction spinning, efforts are directed to production of yarns which can be used for the clothing industry, since these yarns represent the greatest proportion, that is up to 60%, of all produced yarns.

In order to substantially avoid the previously mentioned loop states or configurations of the fibres, that is, in order to feed the fibres to the yarn end in a substantially stretched-out or straight state or configuration, the German published Pat. No. 3,300,636, published July 12, 1985, proposes an open-end friction spinning device with two rolls driven in the same sense and arranged closely mutually adjacent to form a wedge-shaped gap or throat, at least one of which rolls is constructed as a suction roll. A feed passage opens onto this suction roll and is arranged in the peripheral direction of the suction roll, in a predetermined spaced relationship, to the wedge-shaped gap. Furthermore, the edge of the feed passage opening directed towards the wedge-shaped gap is formed as a diverting guide for the delivered fibres. This formation is intended to ensure that the fibres are braked at the diverting guide while they are drawn out of the feed passage by means of the suction roll, and thus are subjected to a mechanical stretching. This mechanical stretching effect is intended to lead to an improvement in the laying down of the fibres.

However, the disadvantage of such a device is that, on the one hand, the fibres are subjected to friction, without which this stretching can not be achieved, and that, on the other hand, edges of the device generating such friction are subjected to the danger of contamination, so that occasionally an accumulated clump of dirt may be carried along by the passing fibres and can produce irregularities in the yarn.

SUMMARY OF THE INVENTION

Therefore, with the foregoing in mind, it is a primary object of the present invention to provide a new and improved method and apparatus for spinning a yarn or the like which does not exhibit the aforementioned drawbacks and shortcomings of the prior art constructions.

Another and more specific object of the present invention aims at providing a new and improved method and apparatus of the previously mentioned type for spinning a yarn or the like in which a yarn produced by friction spinning means contains fibres with an improved orientation.

It is a further object of the invention to bring the fibres, before they are bound into the yarn end, into a disposition on the suction drum which is advantageous for binding the fibres into the yarn end.

Yet a further significant object of the present invention aims at providing a new and improved construction of an apparatus of the character described for spinning a yarn or the like which is relatively simple in construction in design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the method of the present invention is manifested by the feature that it comprises the steps of delivering the fibres transported on the moving surface to the yarn formation position lying on the moving surface in substantially straightened configurations and simultaneously in a rearwardly inclined orientation as viewed in the predetermined withdrawal direction of the yarn.

The apparatus of the present invention is manifested by the features that: the fibre feed passage converges in such manner that the pneumatic, fibre-transporting air stream is increasingly accelerated; the longitudinal section of the exit opening has a breadth of at most 2 millimeters and is so selected that air of the pneumatic, fibre-transporting air stream flowing through the exit opening has a speed such that leading ends of the fibres caught by the moving perforated surface in the region of the exit opening are diverted in a direction extending substantially normal to the longitudinal section of the exit opening; and the fibre feed passage is so arranged that the fibres are taken up substantially freely by the moving perforated surface without substantial diversion at edges of the exit opening.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 12 shows a reproduction of a photograph of a test arrangement corresponding to the apparatus of FIG. 1.

DETAILED DESCRIPTION OF THE PREFERRED EMBODIMENTS

Figure 1:
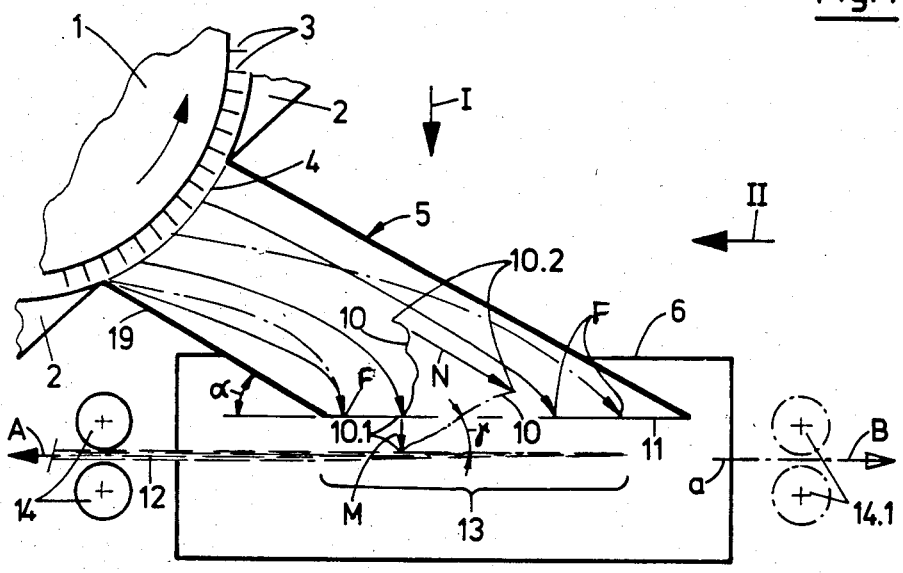
FIG. 1 schematically shows a cross-section through an apparatus constructed according to the invention.
Figure 2:
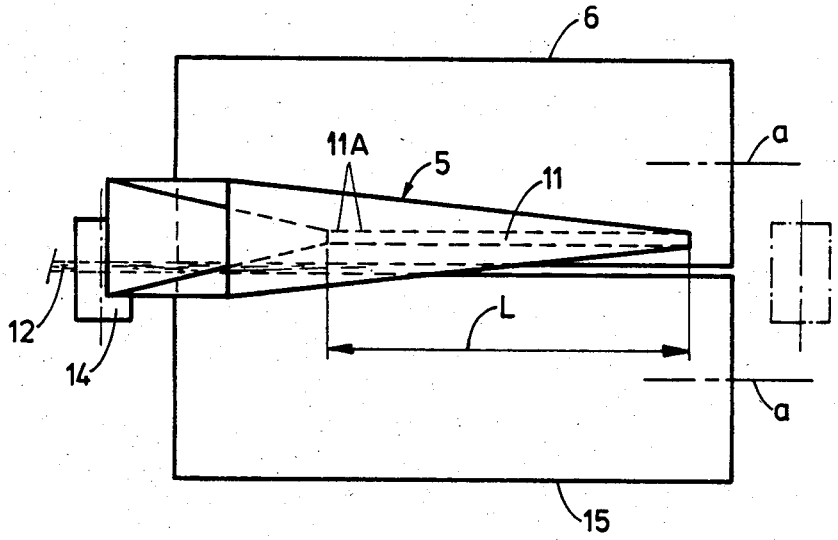
FIG. 2 schematically shows a plan view of a portion of the apparatus viewed in the direction of the arrow I in FIG. 1.

Describing now the drawings, it is to be understood that to simplify the showing thereof only enough of the structure of the apparatus for spinning a yarn or the like has been illustrated therein as is needed to enable one skilled in the art to readily understand the underlying principles and concepts of this invention. Turning now specifically to FIG. 1 of the drawings, the apparatus illustrated therein by way of example and not limitation and employed to realize the method as hereinbefore described will be seen to comprise an opening roller 1 known per se from the open-end rotor spinning method and only generally indicated in FIG. 1. The opening roller 1 is supported in a housing 2 (only partially illustrated) and must be suitably driven. The opening roller 1 is provided in known manner with not particularly shown teeth or needles 3 for the separation of fibre sliver into individual fibres.

As already mentioned, opening roller assemblies with such opening rollers are known from open-end rotor spinning and therefore need not be further described here.

The housing 2 has a fibre exit opening or aperture 4 adjoining a fibre feed passage or channel 5 which opens adjacent to the cylindrical surface of movable friction spinning means constituting a friction spinning drum 6 by means of an exit opening or opening 11 which has a predetermined cross-section. The exit opening or opening 11 has edges and longitudinal sides 11A arranged substantially transversely to a direction of movement of a perforated surface 6*b* of the friction spinning drum 6. A first one of the longitudinal sides 11A of the exit opening 11 forms a first edge 11B facing a yarn formation position 13; a second one of the longitudinal sides 11A of the exit opening 11 forms a second edge 11C remote from the yarn formation position 13 (see FIG. 3).

Figure 5:
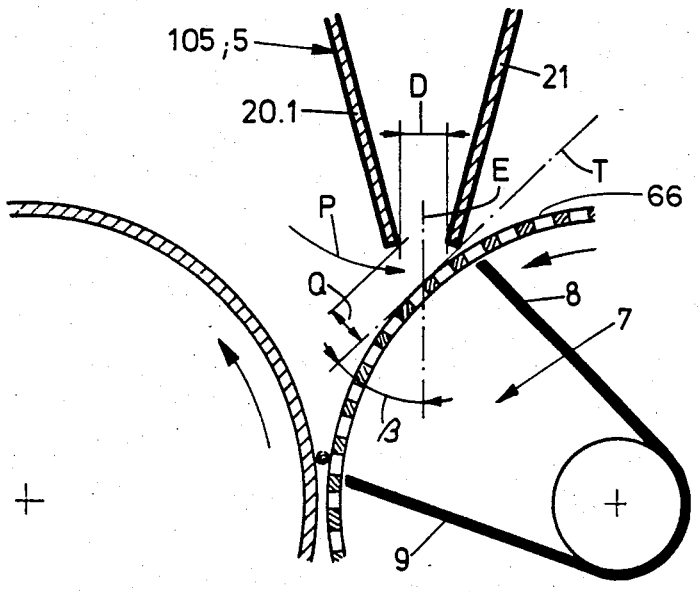
FIGS. 5, 6 and 7 each schematically show a respective detail of the apparatus of FIG. 1 on an enlarged scale.
Figure 6:
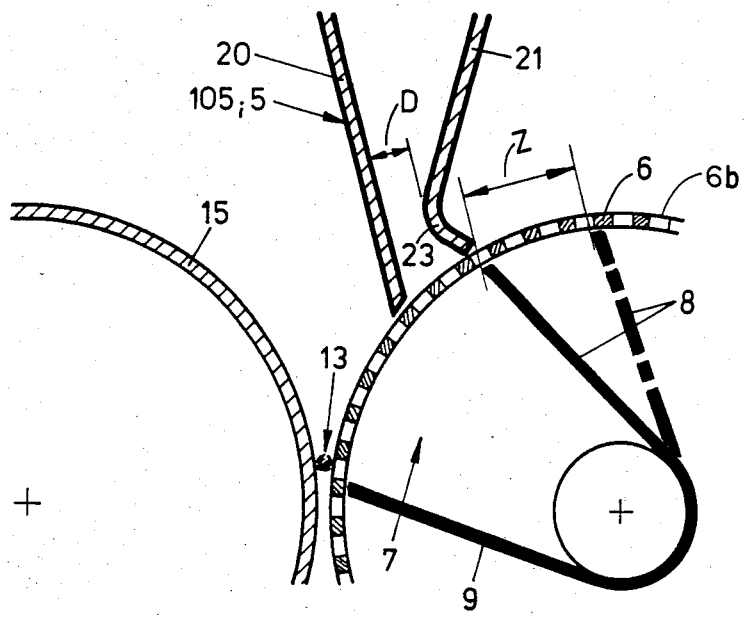
Figure 7:
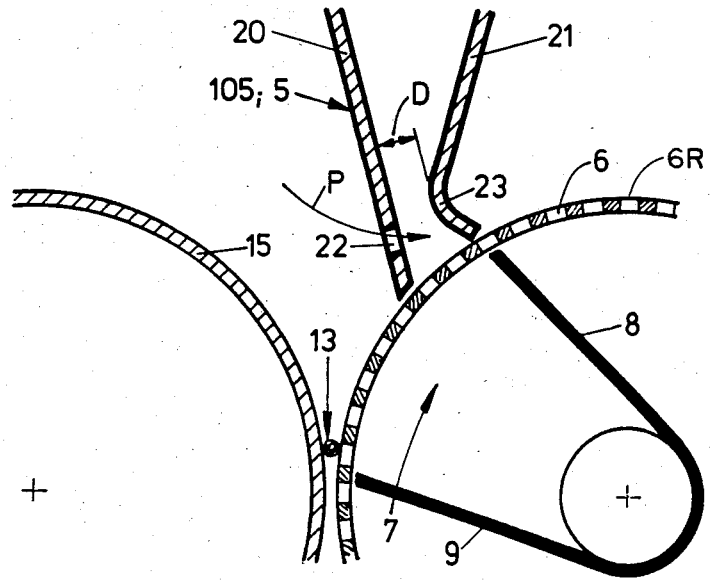

This friction spinning drum 6 is perforated, as may be seen in FIGS. 5, 6 and 7 and contains a suction passage or channel 7 (cf. FIG. 3*a*), which defines by its upper wall 8 and lower wall 9 a suction zone R at the periphery of the perforated friction spinning drum 6 and which draws a pneumatic, fiber-transporting air stream through the perforated surface of the movable friction spinning drum 6. These walls 8 and 9 extend so close to a cylindrical inner wall 6*a* of the perforated friction spinning drum 6, yet without contacting this inner wall 6a, that inflow of leakage air is prevented to as great an extent as possible.

By means of the airflow or fibre transporting air stream produced by the suction passage 7 and flowing along the fibre feed passage 5, the fibres 10 separated by the teeth or needles 3 and freely moving substantially normally to the predetermined cross-section of its exit opening or opening 11 in the feed passage 5 are retained within the suction zone R at the surface portion or region of the rotating perforated friction spinning drum 6 defined by the exit opening or aperture 11 of the fibre feed passage 5, and finally are twisted at the yarn formation position 13 to form a yarn 12 in the border or boundary region of the suction zone R defined by the lower wall 9 of the suction passage 7. The lower wall 9 of the suction passage 7 is located at a predetermined spacing from the exit opening or aperture 11 as viewed in the direction of rotation of the friction spinning drum 6 and forms the yarn formation position 13 which is located at a hypothetical extension of the lower wall 9 through the cylindrical inner wall 6a of the perforated friction spinning drum 6. The perforated friction spinning drum 6 rotates in the direction indicated by the arrow U. The suction passage or channel 7 thus is arranged at the perforated surface 6b of the friction spinning drum 6 opposite to the fibre feed passage 5 and the yarn formation position 13.

The spun yarn 12 is withdrawn in a withdrawal direction A by a withdrawal roller pair 14. As can be seen from FIG. 1, the withdrawal roller pair 14 can also be provided at the opposite end face of the perforated friction spinning drum 6, as represented by the dotted line roller pair 14.1. That is, the yarn can also be withdrawn in the direction B.

In order to assist twisting of the yarn, a second friction spinning drum 15 can be associated with the first-mentioned perforated friction spinning drum 6 and can be arranged so close to the first perforated friction spinning drum 6 that the yarn formed in the converging space or throat between the two friction spinning drums 15 and 6 is twisted to a stronger yarn than would be obtained without this second friction spinning drum 15.

The direction of rotation of the second friction spinning drum 15 corresponds to the direction of rotation of the perforated friction spinning drum 6 and both directions are therefore indicated by the reference character U. Due to the similar rotational directions, the directions of movement or of tangential motion of the two drums 6 and 15 are opposite to each other in the region of the converging space or throat.

Figure 3:
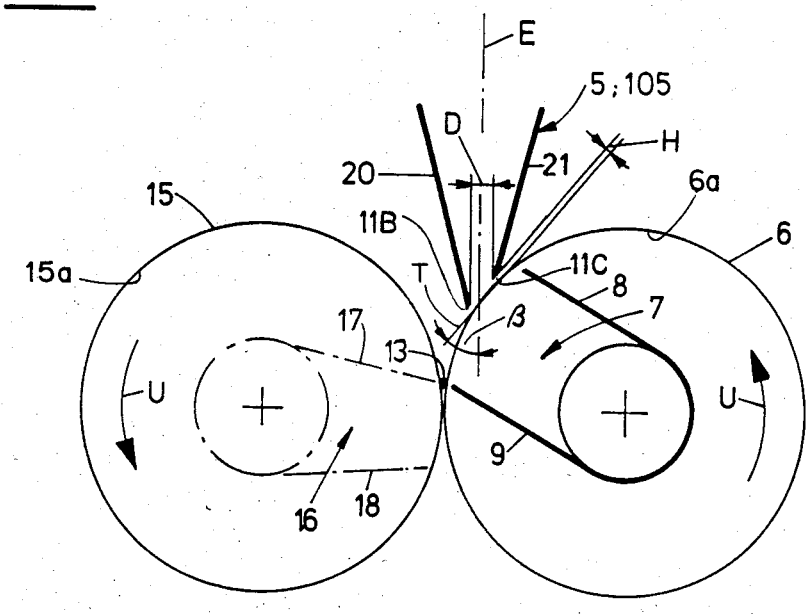
FIGS. 3 and 3*a* each schematically show a portion of the apparatus viewed in the direction of the arrow II in FIG. 1.

The second friction spinning drum 15 can also be perforated and can be provided with a further suction passage 16 (indicated in dotted lines in FIGS. 3 and 3a) defining a suction zone R.1 and containing the walls 17 and 18. Advantageously, the wall 17 of the suction passage 16, which is uppermost as viewed in FIG. 3, is so oriented that a hypothetical extension of this wall 17 through a cylindrical wall 15a of the perforated friction spinning drum 15 intersects the hypothetical extension of the lower wall 9 at the yarn formation position 13, or lies in a line such that the twisting of the fibres 10 at this yarn formation position 13 is optimized by the air streams of the suction passages 7 and 16, which are directed in opposition to each other. There is, however, also the possibility illustrated in FIG. 3a of disposing the walls 9 and 17 relative to each other such that the yarn formation position 13 is located between the hypothetical extensions of the walls 9 and 17.

The lengths of the suction zones R and R.1, although not particularly shown, correspond to at least the length L of the opening 11.

In order to obtain an adequate distribution of the fibres over the length L of the opening 11 of the fibre feed passage 5, the width or breadth D (cf. FIGS. 3, 5, 6 and 7) of the opening 11 should not exceed 2 mm. The length L and the width or breadth D define the cross section of the opening 11; basically, the terms "opening" and "opening cross-section" refer to the narrowest positions or locations in the fibre feed passage 5.

FIG. 1 shows a fibre feed passage 5 with an inclination relative to the cross-section of the exit opening or opening 11 as viewed in the yarn withdrawal direction A and designated by an angle $\alpha$ which is less than 90°, preferably at most 30° the fibre feed passage 5 being formed by a hypothetical extension of the opening 11 and a wall 19, which is lowermost as viewed in FIG. 3. Consequently, the separated fibres 10 in the fibre-transporting air stream are transported in a direction forwardly inclined as viewed in the yarn withdrawal direction A. In contradistinction, the fibre feed passage 105 shown in FIG. 4 has no inclination in the opening region C, but opens with the angle $\alpha$ substantially equal to 90° relative to the drum surface. The opening region C has a height h of at least 10 mm. The remaining elements of FIG. 4 correspond to the elements of FIG. 1 and are therefore conveniently designated by the same reference numerals. Correspondingly, since the opening must meet the requirements stated for the fibre feed passage 5, it is also designated by the reference numeral 11.

Figure 3A:
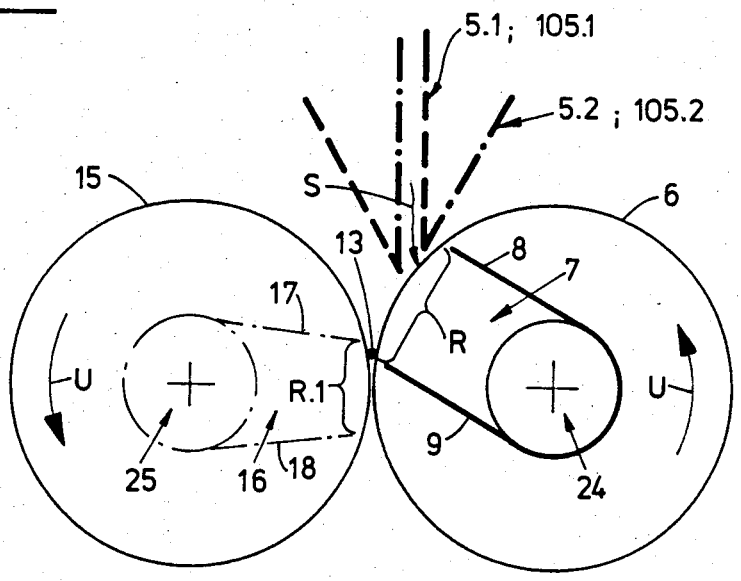

As indicated in FIG. 3a in dot-dash lines and in dotted lines, the fibre feed passages 5 and 105 can be arranged in a disposition differing from that illustrated in full lines in FIG. 3 without disadvantageous results for the guidance of the freely moving fibres 10 towards the cylindrical surface of the perforated friction spinning drum 6. The fibre feed passages in these alternate dispositions are designated in FIG. 3a by the reference numerals 5.1 and 105.1, respectively, and 5.2 and 105.2, respectively.

Depending upon the dispositions of these feed passages 5 and 105, 5.1 and 105.1 and 5.2 and 105.2, respectively, an angle $\beta$ illustrated in FIG. 3 and 5 varies; this angle $\beta$ is formed by a hypothetical symmetry plane E of the corresponding feed passage opening and a tangential plane T at the line of penetration of the symmetry plane E through the cylindrical surface 6a of the perforated friction spinning drum 6.

As indicated in FIG. 3a, the freely floating fibres 10 have the tendency to strike the surface of the perforated friction spinning drum 6 in the direction indicated by the arrow S, and in particular, substantially independently of the disposition of the fibre feed passage indicated by the angle $\beta$. In order to assist this effect of diversion or deflection of the fibres 10 in the direction radial to the surface of the perforated friction spinning drum 6, an external wall or further broad side 20.1 of the fibre feed passage 5 or 105 can, as shown in FIG. 5, be provided at a given spacing Q with respect to the surface of the perforated friction spinning drum 6. In this way, a leakage airflow P is induced, which imparts to the freely floating fibres 10 an increased tendency to strike the surface of the perforated friction spinning drum 6 radially. Another measure, for the same purpose, is illustrated in FIG. 7 by openings 22 (only one of which is shown), in the exterior wall or further broad side 20 of the fibre feed passage 5 or 105, that is the wall or further broad side 20 facing the yarn formation position 13 and forming the first edge 11B of the exit opening or opening 11 and which first edge 11B faces the yarn formation position 13. The openings 22 are placed immediately above such first edge 11B and admit a leakage air flow.

In order to avoid disturbance to the above-mentioned radial flight path or trajectory of the free-floating fibres 10 due to peripheral or ambient airflows damming up in the converging space or throat between the wall or broad side 21 of the fibre feed passage 5, 105, there is provided between the second edge 11C formed by the second one of the longitudinal sides 11A of the exit opening or opening 11 and the surface of the rotating friction spinning drum 6, a spacing H and such spacing H should be held as small as possible without causing direct contact between this wall 21 or the edge 11*c* and the cylindrical surface of the perforated friction spinning drum 6. The first edge 11B formed by the first one of the longitudinal sides 11A of the exit opening or opening 11 extends less closely toward the perforated friction spinning drum 6.

In addition to, or in place of, the above-mentioned measure, the spacing or small gap H can, as shown in FIG. 6, be set back along with the upper wall or the wall 8 of the suction passage 7 through a distance Z of preferably a maximum of 3 mm opposite to the direction of rotation U, so that the previously mentioned peripheral or ambient air-flows or currents are eliminated in the region Z by the suction passage 7.

Finally, as shown in FIGS. 6 and 7, the wall or broad side 21 of the fibre feed passage 5, 105 and located remote from the yarn formation position 13, can be provided in the region of the exit opening 11 with a bend 23 directed oppositely to the direction of rotation U, which bend 23 causes increased diversion or deflection of the flow corresponding to the direction of the arrow S. This broad side 21 forms the second edge 11C of the exit opening or opening 11.

Each suction passage 7 or 16 (cf. FIG. 3*a*) is connected to a respective source of underpressure or vacuum by a connection tube or conduit 24 and 25, respectively, in known manner. Furthermore, the perforated friction spinning drums 6 and 15 are appropriately supported and driven in known manner as symbolically represented by the axes a. Drive and support systems for such perforated friction spinning drums are known per se and are not subject matter of the present invention.

Figure 8:
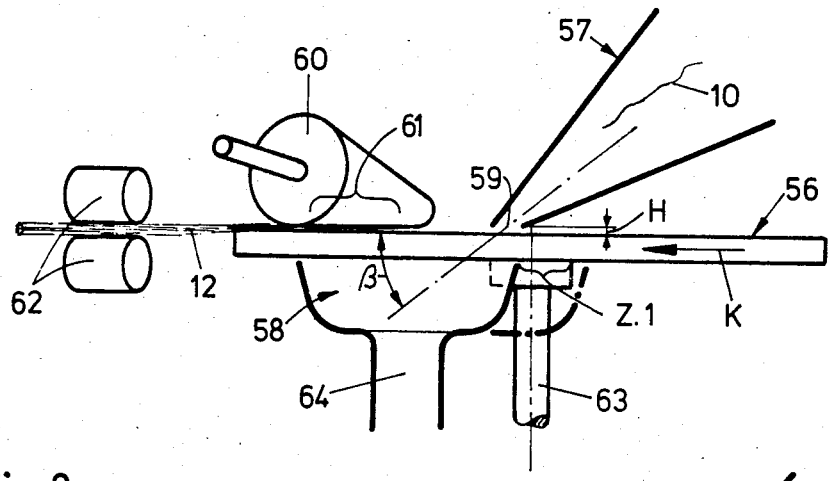
FIG. 8 schematically shows a partial view of a further embodiment of the apparatus according to the invention.
Figure 9:
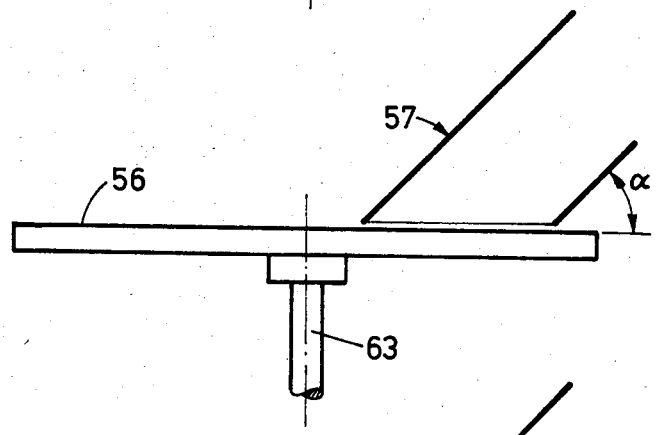
FIGS. 9 and 10 schematically show modifications of a detail of the apparatus of FIG. 8.

FIG. 8 shows a modification of the apparatus according to the invention in which the movable friction spinning means constitute a perforated friction spinning disc 56 is used in place of the perforated friction spinning drum 6. The perforated friction spinning disc 56 rotates in the rotational direction K and takes up the freely floating fibres 10 delivered by a fibre feed passage 57. This fibre feed passage 57 is arranged at an inclination to the surface of the perforated friction spinning disc 56 at an angle $\beta$ in a manner analogous to the arrangement of the fibre feed passages 5 and 105.

Figure 11:
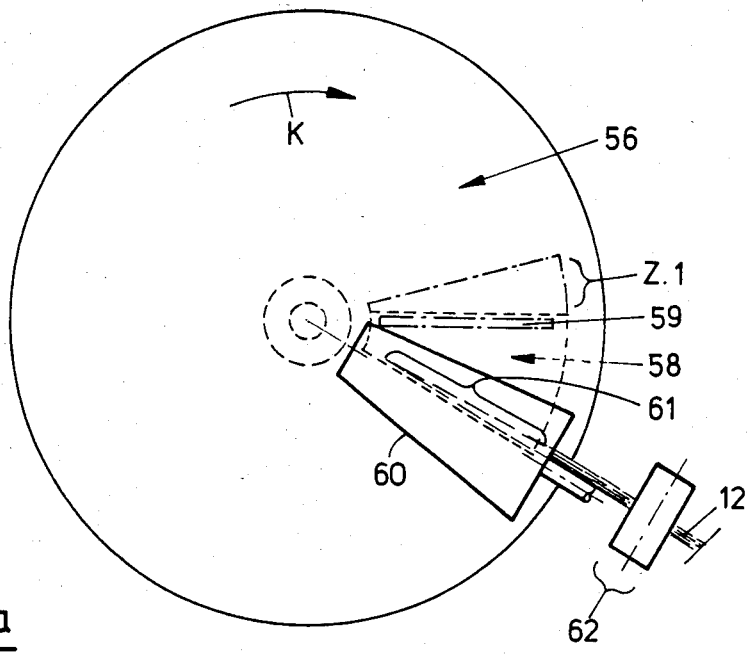
FIGS. 11 and 11*a* schematically show respective plan views of the modified apparatus of FIG. 9.

A suction passage 58 is provided at the underside of the perforated friction spinning disc 56 in a manner analogous to the suction passage 7. As shown in FIG. 11, the suction passage 58 covers a region which extends outwardly from an opening 59 of the fibre feed passage 57 to a location beyond a yarn formation position 61, which is formed by a surface of the perforated friction spinning disc 56 and a frusto-conical friction spinning roller 60. The spun yarn 12 is withdrawn by a withdrawal roller pair 62.

The perforated friction spinning disc 56 is fixedly secured to a shaft 63. For simplicity of illustration, support and drive means for the shaft 63 have not been shown and are not subject matter of the present invention. The same applies to the support and drive means for the frusto-conical friction spinning roller 60.

Figure 4:
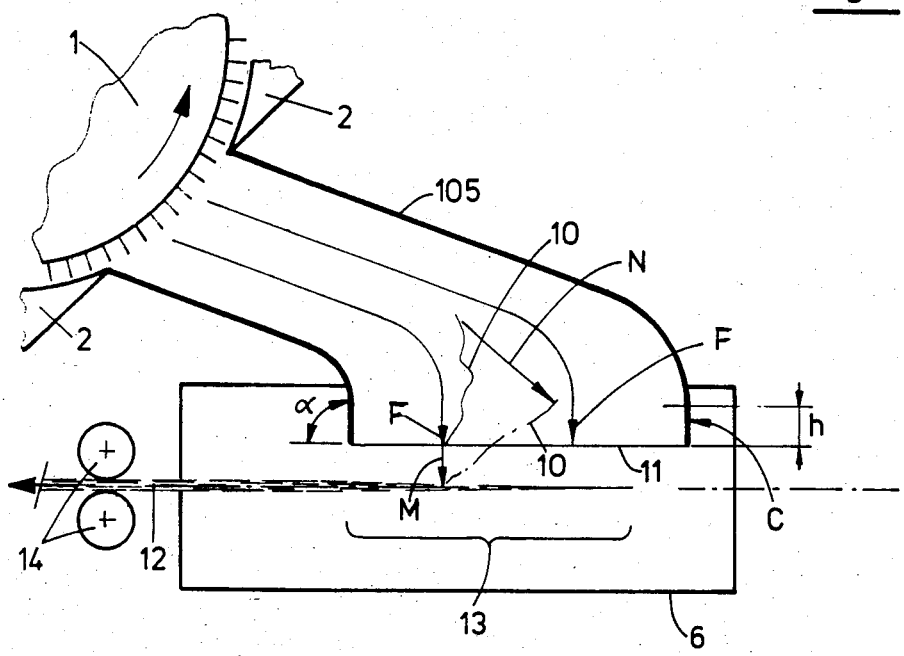
FIG. 4 schematically shows a modification of the apparatus of FIG. 1.
Figure 10:
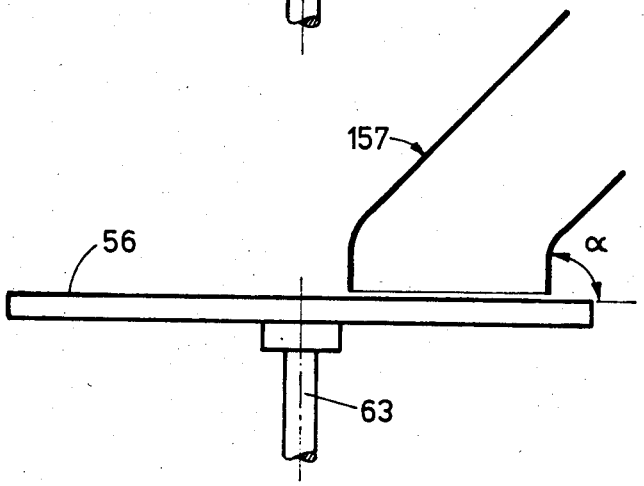

The fibre feed passage 57 can be provided with an angle of inclination $\alpha$ of less than 90° in a manner analogous to the fibre feed passages 7 of FIGS. 1 and 4 or, as shown in FIG. 10, with an angle $\alpha$ of substantially 90°.

As shown in FIGS. 8 and 11, the suction passage 58 can be broadened in the direction opposite to the direction of movement K of the perforated friction spinning disc 56, so that in the region indicated at Z.1 the ambient air present at the surface of the moving perforated friction spinning disc 56 can be eliminated before the opening 59 into the passage 58. Passage 58 is connected by a connector element 64 to a not particularly shown source of underpressure or vacuum.

The remarks made with respect to the spacing H (cf. FIG. 8) in connection with the use of the perforated friction spinning drum 6 apply in a similar manner to the use of the perforated friction spinning disc in place of the perforated friction spinning drum 6. The same applies for the remarks in connection with the bend 23 shown in FIGS. 6 and 7 and in connection with the openings for through-flow or passage of a leakage air stream P.

Basically, it is advantageous if the fibre feed passages converge in such manner that the air flowing therein is subjected to an acceleration such that the fibres 10 transported in the air undergo at least a preliminary straightening.

In the method according to the invention, the described apparatuses are operated as follows:

Preliminary remark:

Tests have shown that the relationship between the peripheral speed of the perforated friction spinning drums and the air speed at the opening or the fibre speed, which amounts to at least 40% of the air speed of the air stream in the cross-section of the exit opening or opening 11, at the opening is of decisive importance.

For example, it has been established that as the ratio of the air speed at the opening 11 to the peripheral speed of the associated moving perforated surface 6*b* or the perforated friction spinning drums is raised above a value of 5:1, the strength and uniformity or regularity of spun the yarn 12 deteriorate as a result of increasing loop formation or kinking until, for example, at a ratio of 10:1, the spun yarn is no longer usable.

If, however, the above mentioned ratio of air speed to peripheral speed is selected in a region of ratio below 2:1, then the strength also progressively diminishes, but a still usable spun yarn 12 is obtained even at a ratio lower than 1:1. The mass-uniformity or mass-regularity of the spun yarn 12 is also influenced by this ratio in the same sense as the strength. This effect can be explained as follows:

If the moving perforated surface 6*b* or the perforated friction spinning drum 6 has a higher peripheral speed than the free fibres 10 leaving the opening 11, then the fibres 10 are stretched out or extended upon being caught by the perforated friction spinning drum 6 and are taken up substantially in the peripheral direction on the moving perforated surface 6*b* or the perforated friction spinning drum 6 and in the yarn end being formed at the yarn formation position 13.

The previously-mentioned effect occurs with an inclined fibre feed passage 5 as shown in FIG. 1 or with a fibre feed passage 105 having a vertically arranged end portion as shown in FIG. 4.

On the other hand, if the relationship of the air speed at the opening 11 to the peripheral speed of the moving perforated surface 6b or the perforated friction spinning drum 6 is selected in the region between 2:1 and 5:1, then the following difference is found between the employment of a fibre feed passage 5 inclined at an angle $\alpha$ as illustrated in FIG. 1 and the employment of a fibre feed passage 105 as illustrated in FIG. 4:

With a fibre feed passage 105 in accordance with FIG. 4, and with a ratio of air speed to peripheral speed of more than 3:1, the fibres 10 are laid or deposited on the perforated friction spinning drum 6 increasingly in looped or kinked configurations which become more unfavorable as the ratio is increased.

Where, however, an inclined fibre feed passage 5 is used as illustrated in FIG. 1, and with a ratio of air speed to peripheral speed of more than 1:1, then the fibres 10 are laid or deposited in an increasingly inclined disposition or orientation on the moving perforated surface 6b or on the perforated friction spinning drum 6, which tendency increases as the peripheral speed is reduced and reaches a maximum when the ratio of air speed to peripheral speed is 5:1. With further increasing ratio, that is above 5:1, the fibres also begin to be laid or deposited in the previously-mentioned looped or kinked state or configuration on the moving perforated surface 6b or on the perforated friction spinning drum 6.

The above-mentioned inclined disposition of the fibres 10 on the moving perforated surface 6b or on the perforated friction spinning drum 6 is preceded by a straightening process in the fibre feed passage 5, so that the fibres 10 on the moving perforated surface 6b or on the perforated friction spinning drum 6 not only lie in a substantially straight disposition or configuration, but also in a direction or orientation which is advantageous for the formation of the yarn end. This advantageous disposition or orientation can only be optimally exploited, however, if the yarn withdrawal direction A is such that the fibres 10 with an inclined alignment or orientation are subjected to a further straightening during withdrawal of the spun yarn 12, that is if the yarn withdrawal direction A is opposite to the direction of fibre feed in the fibre feed passage 5. The achievement of the inclined disposition or orientation of the fibres 10 on the moving perforated surface 6b or on the perforated friction spinning drum 6 will now be explained in the following with the aid of FIG. 1 and with the benefit of the foregoing preliminary remark:

If the leading end 10.1 of a freely floating fibre 10 is caught by the moving perforated surface 6b or the perforated friction spinning drum 6 and transported in the direction indicated by the arrow M on the perforated friction spinning drum 6 towards the yarn formation position 13, then the trailing free end or position 10.2 is simultaneously further transported by the air stream at a considerable speed in the direction indicated by the arrow N, so that after the leading end 10.1 has moved through the distance corresponding to the arrow M, the fibre 10 takes up substantially the position indicated in dotted lines in FIG. 1, i.e. in a rearwardly inclined orientation as viewed in the direction of movement of the perforated friction spinning drum 6 and as viewed in the yarn withdrawal direction A.

If a fibre laid or deposited on the moving perforated surface 6b or the perforated friction spinning drum 6 in this manner is now guided towards the yarn end being formed at the yarn formation position 13, then the leading end 10.1 (i) is caught by the yarn end and substantially held thereby, while the trailing portion or rest of the fibre 10 remains adhering to the suction drum or moving perforated surface 6b or the perforated friction spinning drum 6 and is thereby guided past the yarn end being formed at the yarn formation position 13 until this fibre portion reaches the region following the suction passage 7 and is released from the moving perforated surface 6b as a result of the cessation of the suction effect; (ii) is caught by the counter-drum or further perforated friction spinning drum 15; (iii) is held by the latter; and (iv) is again led past or around the yarn end in a direction opposite to the direction of movement of the first-mentioned moving perforated surface 6b or perforated spinning drum 6 while on the surface of the counter-drum or further perforated friction spinning drum 15, until the fibre or trailing portion, which has been shortened in the interim, is again caught and guided by the suction air stream towards the first moving perforated surface 6b or perforated fricton spinning drum 6 and is again caught thereby. Thereafter, this procedure is repeated alternatingly or reiterated until the fibre 10 is wound about or fully wrapped around the yarn end. This winding procedure produces a certain rotation in the yarn end which, however, is relatively small and of little significance compared to the winding or wrapping speed of the fibre end. In fact, the yarn end is practically stationary relative to the moving perforated surface 6b and is rotating slowly in absolute terms.

The method according to the invention is therefore distinguished from the initially described prior art process in that, on the one hand, no attempt is made to cause the fibres 10 to take up a disposition parallel to the yarn end and, on the other hand, no attempt is made to impart a rotation to the yarn end, but rather the previously-mentioned rotation of the yarn end is a side effect of the method of wrapping the fibres 10.

Proof or substantiation of this theory of operation is provided by the photograph reproduced as FIG. 12, from which it can be clearly seen that the fibres take up the mentioned inclined disposition or orientation. For the purpose of a better overall view of the yarn formation, the second perforated friction spinning drum 15 was removed during taking of the photograph, so that although the yarn end appears extremely loose, it is being formed nevertheless.

Tests have shown that the inclined disposition or orientation of the fibres on the moving perforated surface 6b or the perforated friction spinning drum 6, designated by the angle $\gamma$, becomes greater, that is the angle $\gamma$ becomes smaller, the greater the inclination of the fibre feed passage 5 to the moving perforated surface 6b or the perforated friction spinning drum 6. In practice, however, this inclination reaches its maximum with an angle $\alpha$ of approximately 0°.

The explanation for the production of a yarn end despite the absence of a second perforated friction spinning drum 15 is that, as already mentioned, the yarn end is subjected to a certain rotation and, due to this rotation, the end released by the moving perforated surface 6b or the perforated friction spinning drum 6 is rotated back to the upper side until it is again caught by the suction air of the moving perforated surface 6b or the perforated friction spinning drum 6. If the yarn were not withdrawn, as illustrated in FIG. 12, then gradually a bundle of fibres 10 would be created in which the fibres 10 would retain substantially the inclined disposition or orientation on the moving perforated surface or the perforated friction spinning drum 6.

As already mentioned, a further criterion for the uniform or regular distribution of freely floating fibres 10 in the fibre feed passage 5 lies in the breadth D of the cross-section of the exit opening or opening 11; with a breadth of more than 4 mm, the fibres 10 are provided with excessive freedom in their relationship to each other. It turns out that a breadth D of 2 mm. should not be exceeded. The breadth D can be reduced to 0.5 mm, with the disadvantage that the flow resistance is thereby increased. In fact, the breadth D is selected such that the air of the fibre transporting air stream through the exit opening or opening 11 has a speed such that the leading fibre ends 10.1 caught in the region of the exit opening or opening 11 are diverted in a direction normal to the cross-section of such exit opening.

It also appears that with a fibre feed passage 105 as shown in FIG. 4, the fibres 10 do not lie completely in the peripheral direction of the moving perforated surface 6b or the perforated friction spinning drum 6 (or normal to the yarn end), so that the previously described wrapping effect is also present in this variant. Due to the steep disposition or inclination of the fibres 10 to the yarn end, more turns are required for winding the fibres 10, which results in a harder wrapping of the fibres, that is, in a more tightly twisted yarn. Furthermore, with such a disposition or orientation of the fibres 10, there is a certain danger of loop formation during the wrapping process, so that even with tighter winding of the yarn the strength does not necessarily increase.

Also, it must also be mentioned that the fibre speed in a converging fibre feed passage does not correspond to the air speed even in the region of the opening, but on the other hand the ratio of the fibre speed at the opening to the peripheral speed of the friction spinning means is decisive for the aforementioned effects, so that the air speed simply represents a measurable variable by means of which a setting or adjustment value is obtained for a usable result.

The air flow in the fibre feed passage 5, 57, 105 directs the fibres at least in a predetermined region of the exit opening or opening 11, 59 in such manner that the fibres leave the exit opening or opening 11, 59 distributed over at least half of the predetermined length L of the exit opening or opening 11, 59. The fibre feed passage 5, 105, 59 is arranged, in effect, such that the fibres are taken up substantially freely by the moving perforated surface of the friction spinning means without substantial diversion at the edges of the exit opening or opening 11, 59.

An advantageous embodiment of the opening of the fibre transport channel or fibre feed passage 5, in accordance with FIG. 1, consists in forming a converging portion of the end region of this fibre feed passage 5 ending with the opening 11 in such manner that the air speed or fibre-transporting air stream is subjected to a strong increase or acceleration at least in a direction toward the exit opening or opening 11 preferably over the entire length of the air feed passage 5, so that the air flow is diverted or deflected toward the opening. Such a diversion or deflection is indicated by the flow arrow F (FIGS. 1 and 4).

Figure 11A:
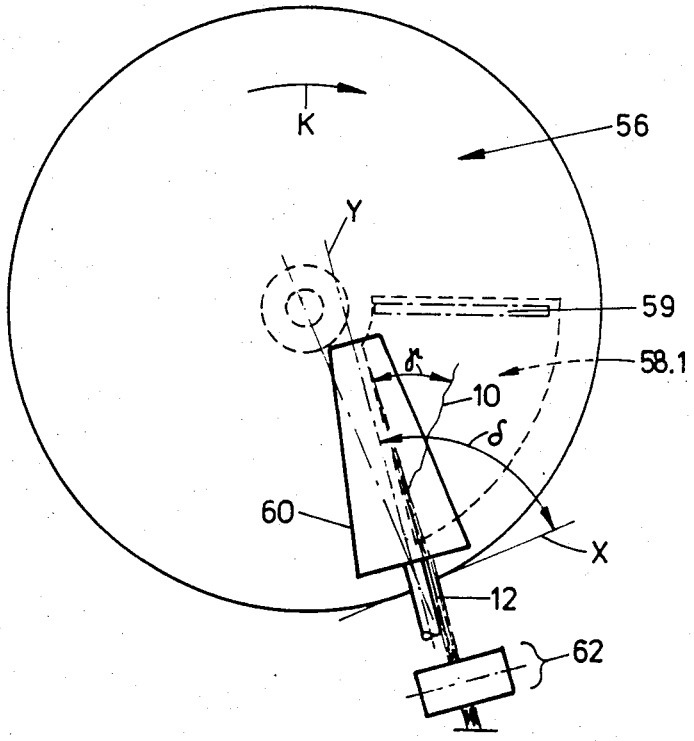

A modification of the apparatus of FIGS. 8 to 11, in which the frusto-conical friction spinning roller or drum 60 is arranged not radially as shown in FIG. 11a, but at an acute angle δ to a hypothetical tangential plane X. The acute angle δ is included between the tangential plane X and a hypothetical plane located at right angles to the perforated friction spinning disc 56 and containing the rotational axis Y of the frusto-conical friction spinning roller 60.

The yarn formation position 61 is thereby set at an inclination in the same sense. The suction passage 58 must therefore be adapted correspondingly in the previously mentioned sense to the yarn formation position 61.

The elements of FIG. 11a correspond to those of FIG. 11, with the exception of the already mentioned adapted suction passage 58.1, so that they have been conveniently designated by the same reference numerals.

Through this inclined arrangement of the yarn formation position 61, the fibres 10 laid or deposited on the perforated friction spinning disc 56 pass in an inclined disposition or orientation to the yarn formation position 61 as indicated with the angle δ. Through this already previously mentioned advantageous disposition or orientation, the fibre 10 can be wound around the yarn end forming at the yarn formation position 61 in the already previously described manner.

While there are shown and described present preferred embodiments of the invention, it is to be distinctly understood that the invention is not limited thereto, but may be otherwise variously embodied and practiced within the scope of the following claims.

Accordingly, what we claim is:

1. A method of spinning a yarn and the like by the open-end friction spinning principle, comprising the steps of:

separating fibres from a fibre sliver;

transferring said separated fibres in a freely floating condition by means of a pneumatic, fibre-transporting air stream to a moving perforated surface of a friction spinning means subjected to underpressure;

selecting a speed relationship between said pneumatic, fibre-transporting air stream and the speed of said moving perforated surface such that said step of transferring said separated fibres entails receiving leading ends of said separated fibres at said moving perforated surface of said friction spinning means and transporting said leading ends of said separated fibres substantially in peripheral direction on said moving perforated surface and that said step of transporting said leading ends of said separated fibres on said moving perforated surface of said friction spinning means entails further transferring trailing portions of said separated fibres to said moving perforated surface of said friction spinning means by said pneumatic, fibre-transporting air strem and receiving said trailing portions of said separated fibres at said moving perforated surface of said friction spinning means such that said transferred fibres assume a rearwardly inclined orientation on said moving perforated surface as viewed in the direction of movement of said moving perforated surface of said friction spinning means and as viewed in a predetermined withdrawal direction of a spun yarn;

transporting said transferred fibres by means of said moving perforated surface to a yarn formation position in which said transported fibres are formed into a spun yarn;

said step of transporting said transferred fibres entails delivering said fibres to said yarn formation position while lying on said moving perforated surface in substantially straightened configurations and simultaneously while lying in said rearwardly inclined orientation as viewed in said predetermined withdrawal direction of said spun yarn; and finally withdrawing said spun yarn in said predetermined withdrawal direction.

2. The method as defined in claim 1, further including the step of:

guiding said pneumatic, fibre-transporting air stream by a fibre feed passage having an exit opening confronting said moving perforated surface;

said exit opening having a predetermined cross-section;

said step of selecting said speed relationship between said pneumatic, fibre-transporting air stream and said moving perforated surface includes selecting the speed of said pneumatic fibre-transporting air stream such as to be at least twice and at most five times greater than the speed of said moving perforated surface; and said fibre feed passage and said pneumatic fibre-transporting air stream both essentially having a direction which is inclined at a predetermined angle of inclination relative to said predetermined cross-section of said exit opening as viewed in said withdrawal direction of said spun yarn.

3. The method as defined in claim 2, wherein:

said fibre feed passage and said pneumatic fibre-transporting air stream both have a direction of extent forming an angle of inclination of at most 30° relative to said predetermined cross-section of said exit opening as viewed in said withdrawal direction of said spun yarn.

4. The method as defined in claim 2, wherein: and said pneumatic, said fibre feed passage and said pneumatic, fibre-transporting air stream have a direction of extent which extends substantially normal to said predetermined cross-section of said exit opening as viewed in said withdrawal direction of said spun yarn.

5. The method as defined in claim 4, wherein:

said pneumatic, fibre-transporting air stream has an air speed such that said fibres in said cross-section of said exit opening have at least 40% of the air speed of said air stream.

6. The method as defined in claim 2, wherein:

said fibre feed passage has a flow which directs said fibres at least in a predetermined region of said exit opening in such manner that said fibres leave said exit opening distributed over at least half of a predetermined length of said exit opening.

7. The method as defined in claim 2, wherein:

said fibre feed passage has a flow which at least in a direction towards said exit opening is subjected to an acceleration.

8. The method as defined in claim 7, wherein:

said fibre feed passage has a flow which over the entire length of said pneumatic, fibre-transporting air stream is subjected to an acceleration.

9. The method as defined in claim 1, comprising the further steps of:

catching said fibres transported by said moving perforated surface of said friction spinning means by a yarn end of said yarn at said yarn formation position at said leading ends of said fibres; and subsequently wrapping said fibres about said yarn end when said yarn end is practicclly stationary relative to a speed of said moving perforated surface and is rotating slowly in absolute terms.

10. The method as defined in claim 9, comprising the further steps of:

catching said leading ends of said fibres at said yarn formation position;

leading trailing portions of said fibres which are portions trailing said leading ends of said fibres, while said trailing portions are adhering to said moving perforated surface, past said yarn end located at said yarn formation position;

subsequently releasing said trailing portions from said moving perforated surface;

leading said trailing portions around said yarn end again in a direction opposite to a direction of motion of said moving perforated surface until said trailing portions are again guided by a suction air stream towards said moving perforated surface and are again caught by said moving perforated surface; and reiterating said procedure until said fibres are fully wrapped around said yarn end.

11. An apparatus for spinning a yarn, comprising:

an opening roller of a type employed in open-end rotor spinning for separating fibres from a fibre sliver;

a moveable friction spinning means comprising a perforated surface;

means for drawing a pneumatic, fibre-transporting air stream through said perforated surface of said moveable friction spinning means;

a fibre feed passage situated between said opening roller and said perforated surface of said moveable friction spinning means for pneumatically transporting said separated fibres by said pneumatic fibre transporting air stream from said opening roller to said moving perforated surface of said movable friction spinning means during operation of the apparatus;

said fibre feed passage having an exit opening;

said exit opening having edges and longitudinal sides;

said longitudinal sides being arranged substantially transverse to a direction of movement of said moving perforated surface;

said fibre feed passage being so inclined in relation to said longitudinal sides of said exit opening that said separated fibres in said pneumatic, fibre transporting air stream are transported in a direction which is forwardly inclined at a predetermined angle of inclination relative to said longitudinal sides of said exit opening as viewed in a predetermined withdrawal direction of the spun yarn;

a suction passage defining a suction zone;

said suction passage having a lower wall;

said lower wall of said suction passage being arranged at a predetermined spacing from said exit opening as viewed in a direction of movement of said moving perforated surface of said moveable friction spinning means;

said lower wall forming a yarn formation position on said moveable friction spinning means;

said suction passage being arranged at said preforated surface of said moveable friction spinning means opposite to said fibre feed passage and said yarn formation position;

said fibre feed passage converging in a direction toward said exit opening in such manner that said pneumatic, fibre-transporting air stream is accelerated during operation of the apparatus;

said exit opening having a cross-section of a breadth of at most 2 mm and being so selected that air of said pneumatic, fibre-transporting air stream flowing through said exit opening during operation of the apparatus has a speed such that leading ends of said separated fibres caught in the region of said exit opening are diverted in a direction extending substantially normal to said cross-section of said exit opening; and said fibre feed passage being so arranged that said separated fibres are taken up substantially freely by said moving perforated surface and without substantial diversion at said edges of said exit opening during operation of the apparatus.

12. The apparatus as defined in claim 11, wherein:

said fibre feed passage is arranged substantially normal to said cross-section in a region of said exit opening so that said separated fibres in said pneumatic, fibre-transporting air stream are transported in a direction substantially normal to said cross-section of said exit opening.

13. The apparatus as defined in claim 11, wherein:

said fibre feed passage has a broad side on a side remote from said yarn formation position;

said fibre feed passage having a bend broadening said exit opening and directed opposite to the direction of movement of the movable friction spinning means and located in a region of said exit opening at said broad side of said fibre feed passage; and said broad side forming one of said edges of said exit opening which edge is located remote from said yarn formation position.

14. The apparatus as defined in claim 11, wherein:

said suction passage has an upper wall; and said upper wall defining said suction zone and being displaced from the fibre feed passage through a predetermined distance in a direction opposite to said direction of movement of said moveable friction spinning means.

15. The apparatus as defined in claim 14, wherein:

said predetermined distance is at most 3 mm.

16. The apparatus according to claim 11, wherein:

said longitudinal sides of said exit opening constitute a first longitudinal side and a second longitudinal side;

said first longitudinal side of said exit opening forming a first edge of said exit opening and facing said yarn formation position;

said second longitudinal side of said exit opening forming a second edge of said exit opening located remote from said yarn formation position;

said first longitudinal side extending less closely toward said perforated surface of said moveable friction spinning means than said second longitudinal side; and said second longitudinal side extending so close to said perforated surface that air moved by said perforated surface towards said second edge of said exit opening is substantially unable to penetrate into said exit opening.

17. The apparatus as defined in claim 16, wherein:

said fibre feed passage possesses a further broad side on a side facing said yarn formation position;

said further broad side of said fibre feed passage forming said first edge of said exit opening and which first edge faces said yarn formation position; and said further broad side of said fibre feed passage having openings for admitting a leakage air flow and provided immediately above said first edge of said exit opening.

18. The apparatus as defined in claim 11, wherein:

said fibre feed passage is so inclined in relation to said longitudinal sides of said exit opening that said separated fibres in said pneumatic, fibre-transporting air stream are transported in a direction which is inclined at an angle of inclination of at most 30° relative to said longitudinal sides of said exit opening as viewed in said predetermined withdrawal direction of the spun yarn.

19. An apparatus for spinning a yarn, comprising:

an opening roller of a type as employed in open-end rotor spinning for separating fibres from a fibre sliver;

moveable friction spinning means containing at least one perforated surface and defining a predetermined yarn withdrawal direction;

means for moving at a predetermined moving speed said moveable friction spinning means including said at least one perforated surface thereof during operation of the apparatus;

a fibre feed passage situated between said opening roller and said at least one perforated surface of said moveable friction spinning means;

means for producing an air stream of a predetermined air speed and flowing through said fibre feed passage toward and through said at least one perforated surface of said moveable friction spinning means;

said air stream, during operation of the apparatus, constituting a pneumatic, fibre-transporting air stream pneumatically transporting separated fibres from said opening roller through said fibre feed passage to said at least one moving perforated surface of said moveable friction spinning means;

said fibre feed passage extending substantially transversely relative to said at least one perforated surface of said moveable friction spinning means and being inclined at a predetermined angle of inclination as viewed in said predetermined yarn withdrawal direction;

said fibre feed passage defining an exit opening extending over a predetermined length along said at least one perforated surface of said moveable friction spinning means;

said fibre feed passage converging in a direction toward said exit opening in order to thereby accelerate said pneumatic, fibre-transporting air stream passing through said fibre feed passage and said exit opening; and said fibre feed passage being arranged and said air speed of said pneumatic fibre-transporting air stream and said moving speed of said moving perforated surface of said moveable friction spinning means, during operation of the apparatus, being adjusted to a predetermined speed relationship such that said separated fibres substantially freely pass through said exit opening of said fibre feed passage, said leading ends of said separated fibres being transferred by said pneumatic, fibre-transporting air stream to and received and transported by said moving perforated surface of said moveable friction spinning means substantially in peripheral direction of said moving perforated surface of said moveable friction spinning means and trailing portions of said separated fibres being transferred by said pneumatic, fibre-transporting air stream to and received on said moving perforated surface of said moveable friction spinning means in a rearwardly inclined orientation as viewed in the direction of movement of said moving perforated surface and as viewed in said predetermined withdrawal direction of the spun yarn.

20. The apparatus as defined in claim 19, wherein:

said predetermined speed relationship between said air speed of said pneumatic, fibre-transporting air stream and said moving speed of movement of said moving perforated surface of said movable friction spinning means during operation of the apparatus is adjusted such that said air speed of said pneumatic, fibre-transporting air stream has a speed at least twice and at most five times greater than said moving speed of movement of said moving perforated surface of said movable friction spinning means.

* * * * *